United States Patent [19]

Staudinger

[11] 4,193,773

[45] Mar. 18, 1980

[54] PROCESS FOR THE PARTIAL COMBUSTION OF PULVERIZED COAL

[75] Inventor: Gernot Staudinger, Amsterdam, Netherlands

[73] Assignee: Shell Internationale Research Maatschappij B.V., The Hague, Netherlands

[21] Appl. No.: 834,890

[22] Filed: Sep. 20, 1977

[30] Foreign Application Priority Data

Sep. 23, 1976 [NL] Netherlands ..... 7610560

[51] Int. Cl.[2] ..... C10J 3/50

[52] U.S. Cl. ..... 48/210; 48/86 R; 48/197 R; 48/DIG. 4; 110/101R; 239/427.3; 239/430; 239/433; 431/10; 431/354

[58] Field of Search ..... 48/77, 76, 86 R, 63, 48/101, 107, 197 R, 210, DIG. 4; 252/373; 110/28 A, 28 R, 101 R; 431/354, 10; 239/427.3, 427.5, 428, 430, 431, 433, 434; 75/42, 41

[56] References Cited

U.S. PATENT DOCUMENTS

| | | | |
|---|---|---|---|
| 2,516,141 | 7/1950 | Newman et al. | 48/DIG. 4 |
| 2,833,643 | 5/1958 | Newman | 75/41 |
| 2,919,185 | 12/1959 | Wahlberg | 75/42 |
| 2,925,335 | 2/1960 | Donath | 48/DIG. 4 |
| 3,048,476 | 8/1962 | Dwyer | 252/373 |
| 3,705,108 | 12/1972 | Marion et al. | 48/215 |
| 3,847,564 | 11/1974 | Marion et al. | 48/215 |
| 3,994,701 | 11/1976 | Schweimanns | 48/197 R |
| 4,007,002 | 2/1977 | Schirmer | 431/10 |
| 4,017,269 | 4/1977 | Dutz et al. | 48/DIG. 4 |
| 4,067,700 | 1/1978 | Switzer | 48/210 |

FOREIGN PATENT DOCUMENTS

| | | |
|---|---|---|
| 850409 | 10/1960 | United Kingdom . |
| 1470820 | 4/1977 | United Kingdom . |

*Primary Examiner*—S. Leon Bashore
*Assistant Examiner*—George C. Yeung
*Attorney, Agent, or Firm*—Pravel, Gambrell, Hewitt, Kirk, Kimball & Dodge

[57] ABSTRACT

Process and apparatus for the partial combustion of pulverized coal, in which the pulverized coal, dispersed in an inert carrier gas, is supplied to a burner, and oxygen is injected into the stream of pulverized coal at two longitudinally spaced locations in the burner for feeding into a gasification reactor.

9 Claims, 1 Drawing Figure

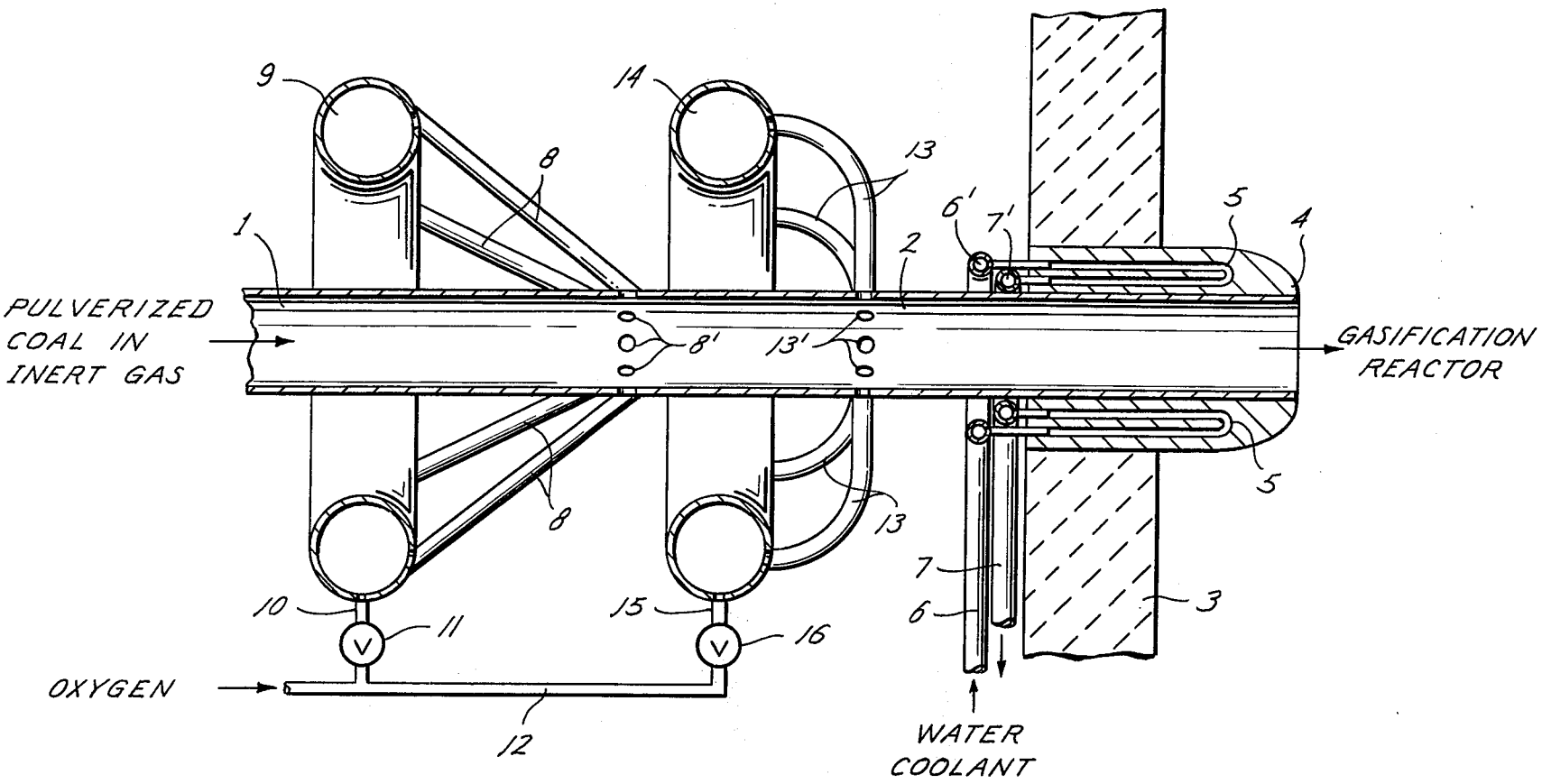
GASIFICATION REACTOR
WATER COOLANT
PULVERIZED COAL IN INERT GAS
OXYGEN
1
2
3
4
5
6
6'
7
7'
8
8'
9
10
11
12
13
13'
14
15
16

PROCESS FOR THE PARTIAL COMBUSTION OF PULVERIZED COAL

BACKGROUND OF THE INVENTION

The field of this invention is coal gasification processes and apparatus.

A coal gasification process has been used in the past, in which pulverized coal was transported in a mechanical manner, with a screw conveyor, to the burner and mixed with oxygen in the burner. Such process operated at atmospheric pressure. In order to obtain a stable flame and to prevent local overheating in the gasification reactor, as well as to achieve the most complete gasification possible, measures were taken to mix the coal particles as completely as possible with the oxygen before the mixture leaves the burner. This meant that the burner had a large length, for example more than a meter.

It has now been found that the controllability of such prior process is not satisfactory. Moreover, the process is unsatisfactory for high pressure gasification, since the use of the long burners entails the danger of detonation, that is to say, the fuel and oxygen commence reaction and may explode in the burner. Also, the stability of the flame is often much more critical at high pressure.

SUMMARY OF THE INVENTION

The invention relates to a process and apparatus for the partial combustion of pulverized coal, in which the latter is introduced via a burner into a gasification reactor together with oxygen. Such a partial combustion takes place in an empty, refactory-lined gasification reactor in which the reaction components react in a flame while forming carbon monoxide and, particularly when steam is also introduced, hydrogen. The residence time of the reaction components in the reactor is relatively short.

According to the invention, the pulverized coal is supplied to the burner dispersed in a carrier gas and the oxygen is injected into the stream of pulverized coal in the burner. The pulverized coal is thus dispersed in the carrier gas upstream of the burner and upstream of the place or places where the oxygen is injected therein. The carrier gas in which the pulverized coal is dispersed should contain little, if any, oxygen and must also be inert in other respects in relation to the carbon. It may consist for example of nitrogen, carbon dioxide, steam, recycled product gas or a mixture of these gases.

An advantage of the process according to the invention is that the oxygen is not mixed with a solid but with a fluid, which mixing can be carried out in a much more efficient and controllable manner.

BRIEF DESCRIPTION OF THE INVENTION

Reference is now made to the drawing, which is partly in section and partly in elevation, and which illustrates the burner of this invention which is suitable for performing the process of this invention.

The drawing is an axial cross-section of a supply line 1 for the supply of a dispersion of pulverized coal in inert carrier gas to a burner barrel 2 which extends through a refractory wall 3 into a gasification reactor, which in the drawing is located to the right of the wall 3. At the front of the barrel 2 is a fire orifice 4 formed of a heat resistant material such as a high melting point metal, which is provided with a water cooling system 5 which is connected to supply and discharge lines 6 and 7 via circular tubes 6' and 7', respectively.

In the barrel 2, a number of oxygen lines 8 debouch or exit at an angle of about 30° relative to the longitudinal axis of the burner barrel 2 via openings which form nozzles 8', which are grouped in a circle in one plane perpendicular to the center line of the barrel 2. The lines 8 are fed from a circular manifold 9, which is connected by a line 10 and an adjustable valve 11 to a main oxygen line 12.

In a similar manner, downstream of the lines 8 a number of oxygen lines 13 discharge into the barrel 2 by openings which form nozzles 13'. The lines 13 discharge into the barrel 2 at an angle of 90° relative to the longitudinal axis of the barrel 2 and are connected to a circular manifold 14, which is connected by a line 15 and an adjustable valve 16 to the main oxygen line 12.

The position of the valves 11 and 16 and the pressure in the main oxygen line 12 are adjusted depending on the quantity of pulverized coal supplied by the line 1 and the desired composition of the gas produced in the gasification reactor 3 as will be explained in more detail. Consequently, the dispersion of pulverized coal in inert carrier gas is mixed with a certain quantity of oxygen from the lines 8 and 13 and at the same time accelerated to more than the velocity minimally required in the burner barrel 2, as described hereinafter.

In the process of this invention, using the above-described apparatus, for example, all possible finely divided solid fuels can be partially combusted, such as hard coal, lignite, pulverized wood, bitumen, soot, etc. The term pulverized coal in the present description comprises all finely divided solid fuels. The combustion takes place with oxygen, air or air/oxygen mixtures, possibly mixed with steam. The steam may also be supplied not via the burner. The term oxygen in the present description comprises oxygen, air, as well as all of the aforesaid mixtures used singly or together.

Preferably, as described in connection with the apparatus, at least some of the oxygen is injected into the stream of pulverized coal in the form of separate jets from separate nozzles. Separate jets have the advantage that a high degree of penetration by the oxygen into the stream of pulverized coal is possible, so that rapid and complete mixing takes place. Also because a number of jets are used, thorough mixing takes place rapidly, which is of importance because the time which elapses between the injection of the oxygen and the entry of the mixture into the gasification reactor must be as short as possible. As illustrated in the drawing, it is preferred to use nozzles in pairs that are positioned at diametrically opposed locations on the burner, in order to improve the mixing as much as possible.

It is also possible according to the invention to inject at least some of the oxygen into the stream of pulverized coal in the form of a film having an annular cross-section, from an annular slit. In this manner the oxygen is added to the stream of pulverized coal in such a manner that the velocity of the stream of pulverized coal can be considerably increased. This manner of oxygen addition is consequently eminently suitable to be combined in the preceding manner, that is to say, some of the oxygen is injected in separate jets as through nozzles 8' and some as a closed film into the stream of pulverized coal.

According to one embodiment of the invention, at least some of the oxygen is injected into the stream of pulverized coal at an angle of 10° to 60° relative to the longitudinal axis of the burner barrel 2, such as through nozzles 8' shown in the drawing. In addition to mixing, this results in acceleration of the stream of pulverized coal.

Also, preferably at least some of the oxygen is injected into the stream of pulverized coal at an angle of 60° to 90° relative to the longitudinal axis of the burner barrel 2, such as through nozzles 13' shown in the drawing. This results in particularly good penetration of the oxygen into the stream of pulverized coal.

According to the preferred embodiment of the invention, some of the oxygen is injected into the stream of pulverized coal at said angle of 10° to 60° upstream of the rest of the oxygen, which rest is then injected into the stream of pulverized coal at said angle of 60° to 90°, using nozzles such as 8' and 13' illustrated in the drawing.

In this manner, the stream of pulverized coal is both sufficiently accelerated and mixed with oxygen, while moreover the supply of pulverized coal to the gasification reactor within the burner itself may be controlled without changing the total carbon/oxygen ratio.

Preferably, according to the invention the velocity at which the oxygen is injected into the stream of pulverized coal is at least five times as large as the velocity of the stream of pulverized coal prior to this injection. This results in both thorough mixing and adequate acceleration of the pulverized coal stream during the mixing with oxygen, which is of some importance for detonation prevention. Preferably, to this end according to the invention the velocity of the stream of pulverized coal is at least doubled by the injection of oxygen.

Good results are achieved in the process according to the invention when the density of the stream of pulverized coal prior to the injection of oxygen is less than 500 $kg/m^3$. At such densities, sufficient oxygen can be administered to influence the velocity of the stream of pulverized coal. In this context, it is noted that to a certain extent the velocity of the stream of pulverized coal, prior to the injection of oxygen, is limited by a necessary restriction in the quantity of carrier gas.

According to a preferred embodiment of the invention in which the pressure in the gasification reactor is at least 10 atm. abs. (atmospheres absolute), the velocity of the stream of pulverized coal after the injection of oxygen is at least 30 m/sec. Under such conditions, no detonation will occur in the burner.

During the partial combustion, a certain fuel/oxygen ratio is generally maintained in order to have a stable flame, a fixed temperature distribution in the reactor and a constant product composition. The process according to the invention produces the maximum effect when 0.5–2.0 kg. of oxygen per kg. of carbon is injected. It is then, for example, possible to select a fixed oxygen/carbon ratio which is maintained during operation. Under these and similar conditions it is then nevertheless possible according to the invention to retain a certain degree of freedom of control, since the possibility is present of injecting the oxygen into the stream of coal powder in several ways simultaneously, while the quantities of oxygen injected in these several ways may be varied.

Thus, in the above-mentioned embodiment in which some of the oxygen is injected at an angle of 10° to 60° and the rest of the oxygen at an angle of 60° to 90°, preferably the amount of oxygen which is injected at an angle of 10° to 60° is adjusted when the amount of carbon supplied with the stream of pulverized coal varies. In this manner the controllability of the gasification process is accomplished.

Thus, it will be understood that this invention relates to a new and improved process and a new and improved apparatus for the partial combustion of pulverized coal, comprising a reactor with at least an outlet for product gas and comprising a burner mounted on the reactor wall for the supply of pulverized coal and oxygen. As previously explained, the burner comprises a line for the supply of a stream of pulverized coal dispersed in a carrier gas, as well as means for the injection of oxygen into the stream of pulverized coal in the burner. Preferably, as explained, the means consists of a number of openings which serve as nozzles for the injection of separate jets of oxygen into the stream of pulverized coal.

The foregoing disclosure and description of the invention are illustrative and explanatory thereof, and various changes in the size, shape, and materials as well as in the details of the illustrated construction may be made without departing from the spirit of the invention.

I claim:

1. A process for supplying pulverized coal for the partial combustion of pulverized coal in a gasification reactor, comprising the steps of:

mixing pulverized coal with a substantially inert carrier gas to form a fluidized stream;

flowing said fluidized stream of pulverized coal in the carrier gas into and through a burner for discharge into a gasification reactor; and injecting at least some oxygen as separate jets directly into said fluidized stream of pulverized coal and carrier gas through separate holes in the burner before substantial burning of said pulverized coal and prior to discharge into a gasification reactor, said oxygen is injected into the stream of pulverized coal at a velocity at least five times as large as the velocity of the stream of pulverized coal in order to double the velocity of the stream of pulverized coal, whereby complete mixing of the stream of pulverized coal with oxygen can be achieved substantially preventing detonation in the burner.

2. The process of claim 1, wherein at least some of the oxygen is injected into the stream of pulverized coal and carrier gas in the form of a film having an annular cross-section.

3. The process of claim 1, wherein at least some of the oxygen is injected into the stream of pulverized coal at an angle of 10° to 60° relative to the longitudinal axis of the stream.

4. The process of claim 1, wherein at least some of the oxygen is injected into the stream of pulverized coal at an angle of 60° to 90° relative to the longitudinal axis of the stream.

5. The process of claim 1, wherein oxygen is injected into the stream of pulverized coal at an angle of 60° to 90° relative to the longitudinal axis of the stream downstream of a place where oxygen is injected into the stream of an angle of 10° to 60°.

6. The process of claim 1, wherein the density of the stream of pulverized coal prior to the injection of oxygen is less than 500 $kg/m^3$.

7. The process of claim 1, wherein the pressure in the gasification reactor is at least 10 atm. abs., and the velocity of the stream of pulverized coal after the injection of oxygen is at least 30 m./sec.

8. The process of claim 1, wherein 0.5–2.0 kg. of oxygen per kg. of carbon is injected.

9. The process of claim 5, wherein the quantity of oxygen is injected into the stream of pulverized coal at an angle of 10° to 60° and is adjusted when the quantity of the carbon supplied by the stream of pulverized coal varies.

* * * * *